United States Patent [19]

Kaufman et al.

[11] 4,012,244

[45] Mar. 15, 1977

[54] HIGH DENSITY IMPULSE SOLID PROPELLANT

[75] Inventors: Martin H. Kaufman; Peter L. Stang, both of China Lake, Calif.

[73] Assignee: The United States of America as represented by the Secretary of the Navy, Washington, D.C.

[22] Filed: Mar. 31, 1961

[21] Appl. No.: 99,967

[52] U.S. Cl. ..... 149/19.3; 149/76; 149/87

[51] Int. Cl.[2] ..... C06B 45/10

[58] Field of Search ..... 52/.5 S; 260/92.1; 149/19, 76, 19.3, 87

[56] References Cited

UNITED STATES PATENTS

| | | | |
|---|---|---|---|
| 2,900,242 | 8/1959 | Williams et al. | 149/22 |
| 2,962,368 | 11/1960 | Guth | 149/19.9 |
| 2,970,898 | 2/1961 | Fox | 149/2 |
| 3,022,149 | 2/1962 | Cramer | 149/19.1 |

OTHER PUBLICATIONS

Farber, Astronautics, pp. 37, 40, 42 (Aug. 1960).

*Primary Examiner*—Edward A. Miller
*Attorney, Agent, or Firm*—R. S. Sciascia; Roy Miller

EXEMPLARY CLAIM

1. A high density solid propellant composition comprising zirconium hydride, ammonium perchlorate and a copolymer of vinylidene fluoride and perfluoropropylene.

5 Claims, No Drawings

HIGH DENSITY IMPULSE SOLID PROPELLANT

The invention described herein may be manufactured and used by or for the Government of the United States of America for governmental purposes without the payment of any royalties thereon or therefor.

The present invention relates to a new and valuable high density solid propellant and to the process of preparation thereof.

Those concerned with the development of solid propellants have long recognized the need for a propellant with a high delivered density impulse, high temperature stability and good safety characteristics along with ease of preparation. A propellant of this type finds its greatest use in those systems where the propellant burnout mass is very large compared to the propellant volume. As variations in the properties are required for a specific application, variations in the formulation are needed. Propellants presently available have density specific impulse values on the order of 430–470 g-sec/cc.

The present invention attains a very high theoretical density impulse of a value between 490 and 622 g-sec/cc which is a considerable increase over prior propellant compositions. It has been found to be stable for long periods of time at 400° F. with little or no change in weight or dimension and is relatively safe to handle.

Therefore, an object of this invention is to produce a solid propellant which will have a higher boost velocity than existing solid propellants.

Another object is to produce a high density material which shows stability at high temperatures as the primary physical requirement.

A further object of this invention is to provide a process amenable to large scale production of a propellant which is difficult to detonate by the usual detonation devices and therefore has commendable safety characteristics.

Still another object of the present invention is to provide a product which is easily extrudable or compression molded.

Other objects and many attendant advantages of this invention will be readily appreciated as the same becomes better understood from the following disclosure.

In the present invention two formulations or compositions were studied, pressed and fired.

| | |
|---|---|
| Formulation I comprises essentially | |
| Zirconium hydride | 50% by weight |
| Ammonium perchlorate | 45% by weight |
| Viton A | 5% by weight |
| Formulation II Comprises essentially | |
| Zirconium hydride | 45% by weight |
| Ammonium perchlorate | 40% by weight |
| Viton A-HV | 15% by weight |

Formulation I has been successfully pressed to greater than 97% of the theoretical maximum density and safety tests show its handling requirements are within normal safety limits; for example, it has a 50% impact number of 30 cm with a two Kg weight but ½-inch sticks of the material could not be detonated by a tetryl pellet. Ten trials at 12.5 joules produced "no fires" thus indicating its safety to electrostatic charges. Taliani test was only 0.05 mm while heat to bring it above 480° F. was required for autoignition.

Formulation II was easily extrudable to 98–99% of the theoretical maximum density. Two star perforated two-inch motors ignited by means of hot wires were successfully fired statically. The following table lists some of the static firing data with two-inch motors:

TABLE 1.

STATIS FIRING DATA

| | Firing I | Firing II |
|---|---|---|
| Average pressure (psi) | 1056 | 1051 |
| Impulse (lb/sec) | 237 | 242 |
| Burning rate (in/sec) | 0.545 | 0.526 |
| $I_{sp}$ (sec) | 185 | 181 |

Formulations I and II may be altered by varying the percentage composition for a possible increase in impulses. Formulations III and IV that follow represent changes which produce propellants easily extrudable to 98–99% of the theoretical density:

| | |
|---|---|
| FORMULATION III | |
| Viton A | 20% by weight |
| Ammonium perchlorate | 60% by weight |
| Zirconium hydride | 20% by weight |
| FORMULATION IV | |
| Viton A | 20% by weight |
| Ammonium perchlorate | 45% by weight |
| Zirconium hydride | 35% by weight |

All the formulations may be altered by exchanging zirconium hydride for either hydrides or metals such as aluminum, boron, zirconium, and titanium, for a possible increase in impulses. If higher temperature stability is desired the oxidizer may be replaced by an alkali perchlorate such as lithium, sodium or potassium perchlorate. Under some conditions a binder with more fluorine may be desirable. Teflon 100X or other of the teflon polymers may be a substitute.

The binder utilized under the tradename Viton A or Viton A-HV is a rubbery copolymer of vinylidene fluoride and perfluoropropylene. A similar copolymer selling under the tradename Fluorel (hexafluoropropyene-vinylidene fluoride) may be used. Teflon 100X is made by copolymerizing tetrafluoroethylene with perfluoropropylene and is a good substitute for Viton A although requiring somewhat higher temperatures for working. Other binders may be utilized including Kel-F which is a homopolymer of chlorotrifluoroethylene and Kel-F elastomer which is a copolymer of chlorotrifluoroethylene and vinylidene fluoride.

The process by which the present invention is made utilizes a resin kettle with a fast propeller stirrer and a stiff rubber baffling device to prevent vortex formation. A stainless steel drum may be used to make larger batches. The required quantity of binder is placed in a container and dissolved in acetone or other suitable solvents known to the art, for example, methylethyl ketone. Approximately 25 cc of acetone per gram of Viton A or Viton A-HV is used. Into this solution at room temperature are stirred the solid ingredients, the hydride and perchlorate. After about 5 minutes of stirring a quantity of a solvent for acetone, two and one-half times by volume that of acetone is added; hexane was used in this invention. Other hydrocarbons such as petroleum ether may be used. After an additional 5 minutes of stirring, the solid is permitted to settle and the liquid is decanted off. Care must be taken at this point to prevent complete decantation, especially, prior to the first washing. Residual acetone will permit easy agglomeration of the powder at this stage if most of the hydrocarbon evaporates off. The remaining solid receives a second hexane wash after which it is decanted off and filtered and air dried or oven dried at 90° C. If a fine powder is desired, the second hexane wash may be decanted off and the wet solid screened.

For comparative purposes the following table lists the test results for formulations I and II of the present invention as against the data for the high explosive, PBXN-2, a composite propellant (E 107) and Nitrasol 3515, which is a double base propellant containing inorganic salts.

TABLE 2.

COMPARATIVE SAFETY TESTS

| Properties | Formulation I | Formulation II | PBXN-2 | E-107 | Nitrasol 3515 |
|---|---|---|---|---|---|
| Autoignition (° C) | 257–260 | 285 | 220 | 260 | 175 |
| Impact (cm/2Kg wt) | 29 | 32 | 44 | 22 | 14–18 |
| VTS(ml gas/g/48hr/120° C) | 0.2 | 0.09 | 1.1 | — | — |
| Taliani(mm/100 min/110° C) | 0.05 | 0.08 | — | 0.1 | 0.36 |
| ΔHexp. calc (cal/g) | 1250 | — | — | — | 1776 |
| ΔHexp. exp (cal/g) | 1310 | 1166 | — | 1149 | — |
| Electrostatic (Joules) | IONF/12.5[a] | IONF/12.5 | 0.6 | — | 5.5 |
| Friction (Kg/cm) | IONF/440 | IONF/440 | 34.6 | — | — |

[a]NF refers to no fires and is generally reported for the limit of an instrument.

These new solid propellant compositions may be extruded or compression molded and machined to appropriate grain size.

Standard cook-off plugs of formulation II of this invention withstood 96.5 hours at 383° F. without cooking off. Over a period of 24 hours the temperature was then raised approximately 60° F. without change. A final rapid increase of 50° F. caused the plug to cook off in a short time.

Three standard plugs of formulation II were put through 5 temperature cycles of +260° F. for 1 hour, ambient for 15 minutes, −85° F. for one hour, then ambient; no change was noticed. Shock cycling three times from 2 hours at +260° F. to 2 hours at −85° F. caused no noticeable ill effects.

Various modifications are contemplated and may obviously be resorted to by those skilled in the art without departing from the spirit and scope of the invention as hereinafter defined by the appended claims.

What is claimed is:

1. A high density solid propellant composition comprising zirconium hydride, ammonium perchlorate and a copolymer of vinylidene fluoride and perfluoropropylene.

2. A high density specific impulse solid propellant composition comprising from 5 to 20% by weight of a copolymer of vinylidene fluoride and perfluoropropylene, 40 to 60% by weight of ammonium perchlorate, and 20 to 50% by weight zirconium hydride.

3. A high density specific impulse solid propellant composition consisting essentially of 45% by weight zirconium hydride, 40% by weight ammonium perchlorate and 15% by weight of a copolymer of vinylidene fluoride and perfluoropropylene.

4. A high density solid propellant composition consisting essentially of about 45% by weight zirconium hydride, 40% by weight ammonium perchlorate and 15% by weight of a copolymer of tetrafluoroethylene and perfluoropropylene.

5. A high density solid propellant composition comprising from 20 to 50% by weight of a metal hydride, 40 to 60% by weight of ammonium perchlorate and 5 to 20% by weight of a polymer selected from the class of binders consisting of a copolymer of vinylidene fluoride and perfluoropropylene, a copolymer of hexafluoropropylene and vinylidene fluoride, a copolymer of tetrafluoroethylene and perfluoropropylene, a homopolymer of chlorotrifluoroethylene and a copolymer of chlorotrifluoroethylene and vinylidene fluoride.

* * * * *